United States Patent [19]

Behunin

[11] 3,936,333

[45] Feb. 3, 1976

[54] METHOD FOR PREFABRICATING BRICK PANELS

[75] Inventor: Gage B. Behunin, Arvada, Colo.

[73] Assignee: Masonry Systems International, Inc., Denver, Colo.

[22] Filed: Mar. 15, 1974

[21] Appl. No.: 451,429

Related U.S. Application Data

[63] Continuation-in-part of Ser. No. 192,027, Oct. 26, 1971, abandoned.

[52] U.S. Cl. ..... 156/60; 52/747; 52/749; 156/71; 156/557; 182/12; 264/31

[51] Int. Cl.[2] ..... E04B 2/00

[58] Field of Search ..... 52/745, 747, 749; 156/71, 156/60, 557; 264/31; 182/12

[56] References Cited

UNITED STATES PATENTS

| | | | |
|---|---|---|---|
| 3,350,833 | 11/1967 | Larger | 52/749 |
| 3,438,171 | 4/1969 | Demarest | 52/749 |
| 3,529,395 | 9/1970 | Edwards | 52/749 |
| 3,696,576 | 10/1972 | deBarros | 52/747 |

*Primary Examiner*—Edward G. Whitby
*Attorney, Agent, or Firm*—Burton, Crandell & Polumbus

[57] ABSTRACT

An assembly line method of prefabricating brick panels in a factory for shipment to the intended site of use includes the steps of mixing a supply of mortar in one area of the plant, placing the mortar in a plurality of pressurized containers which are mounted on a rack located adjacent to the mixing area, delivering each of the pressurized containers and a supply of bricks as required for placement on a horizontally and vertically movable platform, advancing the platform in a direction along the side of a workbench, placing a first row of bricks on the workbench as the platform is advanced in the first direction, reversing the movement of the platform so that it returns in a second direction opposite to the first direction, dispensing under pressure a continuous flow of mortar from each pressurized container along the top of the bricks in the first row, again reversing the movement of the platform to advance in the first direction, and placing a second row of bricks on the previously dispensed mortar.

6 Claims, 10 Drawing Figures

METHOD FOR PREFABRICATING BRICK PANELS

This application is a continuation-in-part of my application Ser. No. 192,027 filed Oct. 26, 1971 now abandoned.

BACKGROUND OF THE INVENTION

1. Field of the Invention

The present invention relates generally to a novel and improved method for prefabricating construction panels and more particularly to a method of prefabricating in an assembly line operation a plurality of brick panels.

2. Description of the Prior Art

The construction industry has been revolutionized by the advent of prefabricated parts and panels. Until recently, these parts and panels were limited to wooden or concrete forms or wall sections. However, recent improvements in flexural and tensile strengths of mortar along with rapid curing rates have increased interest in prefabricated brick panels.

An example of an apparatus and method of prefabricating brick panels is disclosed in U.S. Pat. No. 3,585,092 issued to R. L. Storer on June 15, 1971. The Storer apparatus is adapted to fabricate brick walls from the top row of bricks down, i.e., a row is laid and subsequent rows are formed underneath then bonded to the next adjacent upper row with a layer of mortar.

Examples of prior art apparatus adapted for fabricating brick walls, at a construction site as opposed to in a prefabricating plant, are disclosed in U.S. Pat. No. 3,177,621 issued to D. O. Demarest; U.S. Pat. No. 3,438,171, issued to D. M. Demarest; U.S. Pat. No. 3,325,960 issued to H. H. James; and U.S. Pat. No. 2,599,552 issued to E. L. Harney.

OBJECTS OF THE INVENTION

It is an object of the present invention to provide a new and improved method of prefabricating brick panels.

It is another object of the present invention to provide a new and improved method of prefabricating brick panels wherein a complete row of brick and a complete horizontal layer of mortar are laid alternately in elevating paths until a completed panel has been fabricated.

It is still another object of the present invention to provide a method of fabricating brick panels in a quick and efficient manner whereby substantial savings in labor and overall costs are realized.

SUMMARY OF THE INVENTION

The brick panel prefabricating system of the present invention is a compact system adapted for incorporation into a relatively small prefabricating plant. The plant includes a mixing room where a supply of dry bonding material is mixed in a mixer with sand and water to form mortar. The mortar mixer is pivotally mounted and is provided with a discharge chute whereby mortar can be poured into pressurized mortar dispensing pots on an underlying motorized service cart. The service cart has a plurality of racks for storing pressurized mortar dispensing pots such as of the type disclosed in the copending U.S. Pat. Application Ser. No. 192,016 filed 26 Oct. 1971, now U.S. Pat. 3,786,966, of Gage B. Behunin, which is of common ownership with the present application. Basically the mortar dispensing pots are pressurized containers each having a flexible discharge hose with an adjustable trowel on the end to regulate the rate at which mortar is dispensed from the dispensing pot.

The main body of the prefabricating plant is provided with rows of unique workbenches each of which has two parallel work platforms in back-to-back relation to one another so that a brick panel or panels can be fabricated on each platform by working from both sides of the workbench. Each workbench is provided with movable and readily adjustable panel guides between which the brick panels are fabricated.

Motorized scaffolds are provided to run along tracks disposed on both sides of the workbench adjacent to the work platforms. The scaffolds have a mason support platform which is universally movable in a vertical plane adjacent the workbenches and is also provided with means for supporting a supply of bricks and a mortar dispensing pot so that the mason with his work supplies can conveniently position himself at any desired position adjacent to the wall-to-be. A scaffold specifically adapted for use in the present method of prefabricating brick panels is disclosed in copending U.S. Pat. application Ser. No. 192,015 filed 26 Oct. 1971, now U.S. Pat. No. 3,785,454, of Gage B. Behunin et al which is also of common ownership with the present invention.

An overhead crane services the motorized scaffolds, ensuring that an adequate supply of brick and mortar is available to the masons at all times. The overhead crane which is universally movable in a horizontal plane above the workbenches, transports bricks from a storage area to the scaffolds and also transports the mortar dispensing pots between the storage racks and the scaffolds. The crane is also used to remove completed panels from the workbenches and transport them to a separate storage area in the plant.

With the aforementioned apparatus, brick panels can be easily and efficiently prefabricated in a controlled environment. Aside from the fact that the brick panels can be fabricated on a year-round basis, regardless of the weather conditions outside the plant, it is also possible to control the humidity and temperature within the plant so that the setting time of the mortar can be accurately controlled. By appropriately controlling the environmental conditions, it is possible to fabricate the panels in accordance with a predetermined schedule and procedure without having to concern oneself with unavoidable hazards that are commonplace in on-the-site construction of brick walls.

A preferred method of fabricating brick panels with the apparatus of the present invention includes the steps of mixing a supply of mortar, placing the mortar in a pressurized container, placing the pressurized container and a supply of bricks on a horizontally movable platform, moving the platform in a first direction along the side of a workbench while placing a first row of bricks on the workbench as the platform moves in the first direction, thereafter reversing the movement of the platform so that it moves in a second direction opposite to said first direction while dispensing under pressure a continuous flow of mortar on the top of the bricks in the first row, followed by again reversing the movement of the platform so that it moves in the first direction and placing a second row of bricks on the previously dispensed mortar and repeating the steps of dispensing a continuous flow of mortar on bricks in one row and subsequently placing a row of bricks on the mortar until a completed brick panel has been fabricated.

Other objects, advantages and capabilities of the present invention will become more apparent as the description proceeds taken in conjunction with the accompanying drawings, in which.

Figure 1:
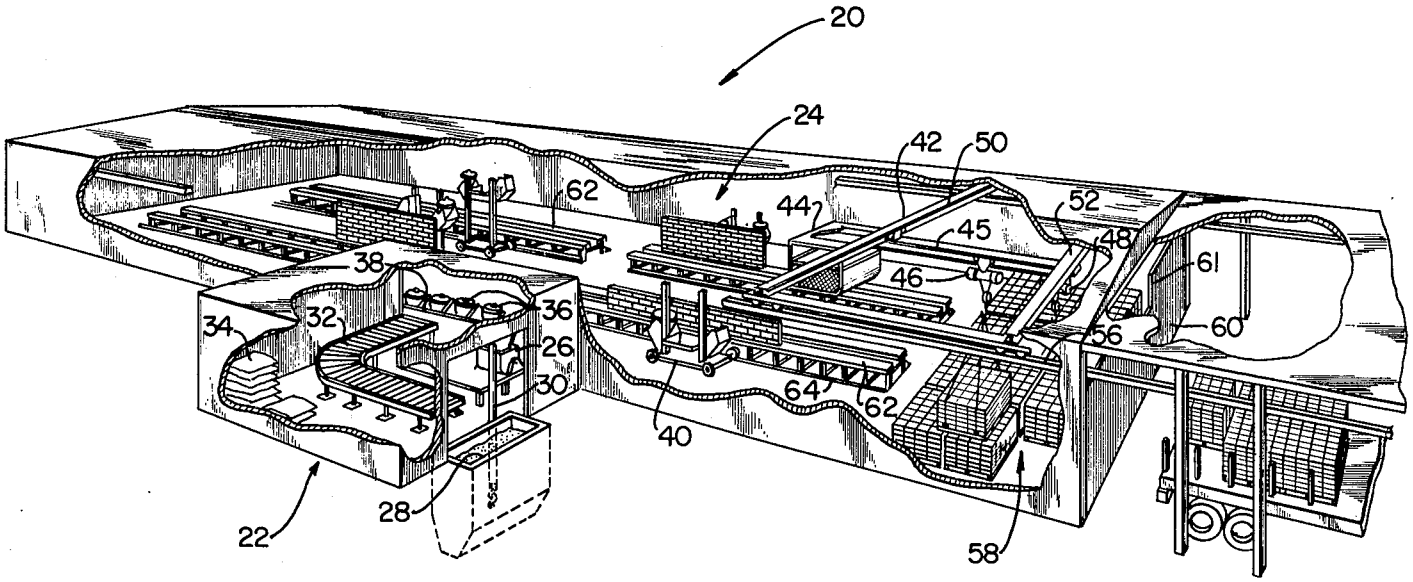
FIG. 1 is a perspective view of a brick panel fabricating plant with parts broken away incorporating the apparatus of the present invention.
Figure 2:
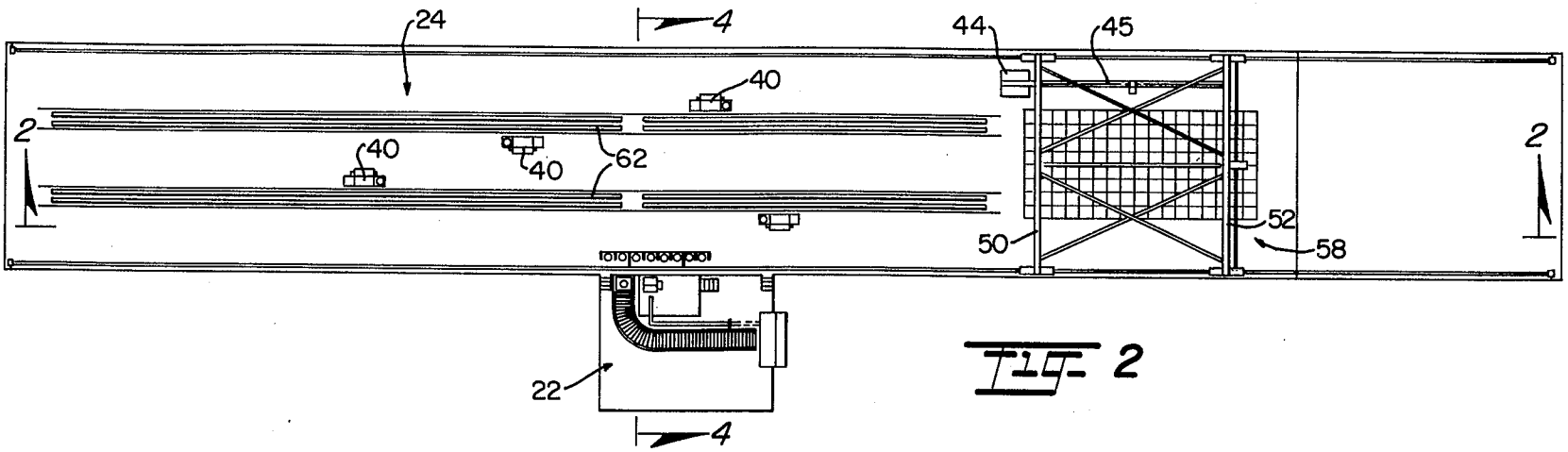
FIG. 2 is a plan view of the apparatus shown in FIG. 1.
Figure 3:
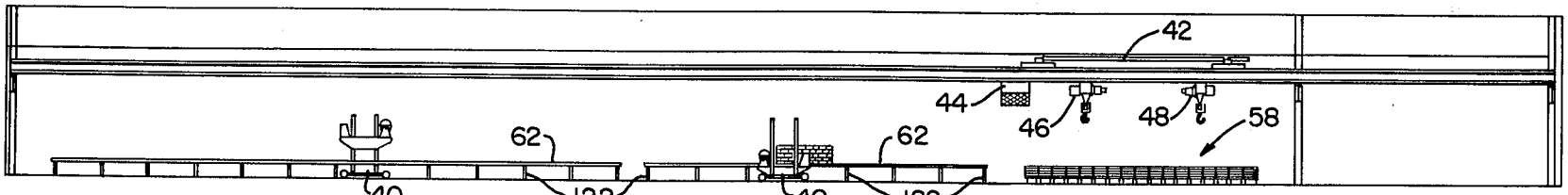
FIG. 3 is a side elevation of the apparatus shown in FIG. 1.
Figure 4:
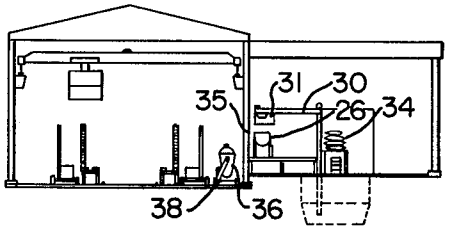
FIG. 4 is an end elevation of the apparatus shown in FIG. 1.

Referring first to FIG. 1, a brick panel fabricating plant 20 is seen to house the fabricating apparatus of the present invention. The plant is broadly comprised of a mortar mixing room 22 and a main body portion 24. The mortar mixing room is provided with a conventional mortar mixer 26, an auger-type conveyor 30 for bringing sand from a concrete-lined sand pit 28 outside the mixing room into the confines of the mixing room, a conventional grain or sand scale 31 mounted above the mixer 26 adjacent the end of the auger 30, and a roller-type conveyor 32 on which heavy bags 34 of dry bonding material can be handled.

Inasmuch as prefabricated brick panels must be transported from the prefabrication plant to the construction site, it is desirable that the completed panels are constructed to be strong and durable so that they can be suspended by overhead cranes, trucked or handled in various other ways before being permanently incorporated into a building structure. To this end, preferably the panels are bonded together with special mortar mixes which give the desired strength; however, if the panels are handled more delicately, other more conventional mortar mixes could be used. Preferred mortar mixes would include as an additive, a latex liquid such as: "Sarabond", manufactured by Dow Chemical Company; "Rohplex", manufactured by Rohm and Haas Chemical Company; "Vinnapas T 53/25 VL", manufactured by Wacker Chemie GmbH; "Vipolet VCA 702", manufactured by Lonza AG, or other suitable alternatives. For illustrative purposes, Sarabond has the following properties:

46% solids
Specific gravity of 1.23
10.25 Pounds per Gallon
PH of 2.0
Particle size approximately 1400 Angstroms
Surface tension at 25°C of 33 dynes per square centimeter
Specific gravity of the solids 1.60

Freezing point of 32°F

Sarabond increases flexural strength of masonry four fold and the tensile strength of masonry three fold over conventional mortar compounds. It is preferable that the proper amounts of ingredients be blended together in a controlled environment to give the desired quality and quantity of mortar. A typical mortar mix utilizing Sarabond would have the following component parts:

| | |
|---|---|
| "Sarabond" | 3–5 gallons |
| Cement | 94 pounds |
| Workability additive | 40–75 pounds |
| Sand | 2½ – 3½ cubic feet |
| Water | As required |

A mortar mix having the additive Sarabond and mixed according to the above specifications has a minimum compressive strength of 5,000 pounds per square inch and a minimum flexural bond of 3,000 pounds per square inch.

The dry bonding material comes in pre-weighed bags and is easily mixed with a proper amount of water, but to add the proper amount of sand, the conventional grain scale 31 is affixed to the end of the housing surrounding the auger-conveyor in a position to receive and weigh sand conveyed by the auger. With this arrangement, when the desired weight of sand has been placed on the scale, the auger is stopped and weighed sand dumped into the underlying mortar mixer 26.

The mortar mixer 26, as stated before, is a conventional unit having a discharge chute 35 through which prepared mortar can be poured. The mixer is mounted for pivotal movement about a horizontal axis whereby it can be tilted to allow prepared mortar to pass through the discharge chute into an awaiting portable mortar dispensing pot 36. The mixer is positioned above a motorized storage cart 38, to be hereinafter described in more detail, adapted to support a plurality of the pressurized mortar dispensing pots 36 which may be of the type disclosed in the copending U.S. Pat. application Ser. No. 192,016 filed 26 Oct. 1971 of Gage B. Behunin. The portable mortar pots are provided with removable caps so that mortar can be poured into the pots through the discharge chute 35 of the mortar mixer 26 thereby filling the pots with any desired quantity of mortar. After the pots have been filled with mortar the caps are replaced and hermetically sealed on the pot so that the pots can be pressurized. When the pots are pressurized and ready for use they are transferred from the storage cart 38 to a motorized scaffold 40 such as the type disclosed in the copending U.S. Pat. application Ser. No. 192,015 filed 26 Oct. 1971 Behunin et al. The mortar pots are transferred to the motorized scaffold 40 by an overhead crane assembly 42 which is universally movable in a horizontal plane overlying the main body 24 of the fabricating plant. A detailed description of a desirable overhead crane may be had by reference to copending U.S. application Ser. No. 192,026 filed 26 Oct. 1971 of Charles Staadt, now U.S. Pat. No. 3,786,936 which is also of common ownership with the present application. In general, however, the overhead crane 42 is provided with a cab 44, mounted on the end of a longitudinally extending beam 45, in which an operator sits while operating the crane from an advantageous viewpoint. The crane is provided with two cable-supported hooks 46 and 48 mounted on the beam 45 which are designed to work in unison so that working supplies as well as completed brick panels can be moved about in the main body of the plant. The hook 46 is mounted for reciprocating movement along the horizontal beam 45 while the hook 48 is stationary at one end of the beam 45 thereby providing more versatility for picking up various length panels. The crane has a pair of cross frame members 50 and 52 which support the beam 50 and are provided with roller wheels on each end which are adapted to ride along longitudinal rails 56 on both sides of the main body of the plant.

Within the plant, it can be seen that one end is provided with a storage area 58 wherein supplies of brick can be stored together with completed brick panels. A truck loading and unloading dock 60 is provided adjacent the storage area 58 outside the plant where truck loads of material can be conveniently loaded and unloaded. It will be noted that the end wall of the plant 20, between the storage section 28 and the loading dock 60, is provided with a generally T-shaped opening 61, having displaceable flaps (not shown), through which the crane 42 can pass when properly oriented to move out of the plant over the loading dock. With this capacity, the same crane that services the interior of the plant can also service the loading dock. It will of course be apparent that the longitudinal rails 56 extend out over the loading dock to support the crane when it is servicing the loading dock.

The remainder of the main body 24 of the plant 20 is provided with a plurality of rows of workbenches 62 on which various sized brick panels can be fabricated. In FIGS. 1–4, only four such workbenches are shown, however, it is understood that any number of workbenches can be provided in the plant by varying the size of the main body 24. Each workbench 62 has elongated parallel back-to-back work support platforms, as will be described in more detail later, on which brick panels can be fabricated so as to most efficiently utilize the floor space in the plant. Each work support platform is provided with a plurality of panel guide assemblies, also to be described in more detail later, for properly aligning the ends of the panels as they are fabricated and a track 64 running parallel along the floor adjacent to each work support platform to guide one of the motorized scaffolds 40 associated with the particular work support platform. With this arrangement, two parallel rows of brick panels can be fabricated on each workbench by working from both sides of the workbench. It will be apparent that more than one panel can be fabricated in side-by-side relationship on each work support platform depending on the length of the panels.

The scaffolds 40 have motor driven means for driving the scaffolds in a horizontal direction along the tracks 64 and also have means for elevating a mason support platform so that the mason positions himself at any location in a vertical plane alongside the workbench. The platform on which the mason stands is also provided with a storage shelf for a supply of bricks and a saddle support for one of the pressurized mortar dispensing pots 36. The controls for operating the motorized scaffold 40 are foot-operated and are on the mason support platform so that the mason can control the movement of the scaffold while leaving his hands free for performing conventional brick-laying functions. It will thus be appreciated that a mason on the motorized scaffold can drive the scaffold back and forth in front of a workbench laying a row of brick when moving in one direction and dispensing an intermediate layer of mortar when moving in the other direction. By repeating this procedure and elevating the mason support platform as the panel height increases, it is possible to fabricate in a quick and efficient manner a brick panel of any desired height and length, within a range determined by the size of the workbenches and panel guides. When the panels are completed, they may be elevated by the overhead crane 42 and transported to the storage area 58 of the plant 20 or to the loading dock from which they can be later loaded onto trucks or other suitable transfer vehicles.

From an overall viewpoint, it is seen that a compact brick panel fabricating plant is provided in which prefabricated brick panels can be economically produced at a relatively rapid rate. The apparatus in the plant is designed and laid out so that the cooperative use of the various components is maximized. More specifically, it can be observed that the mortar is efficiently prepared and poured into a plurality of mortar pots that are stored on a cart and are ready for use as required by masons operating the motorized scaffolds 40. When a mason depletes his supply of mortar in the pot on his scaffold, he needs only to signal the overhead crane operator and the crane can pick up the empty mortar pot, place it on the storage cart 38, pick up a full mortar pot from the cart, and carry the full pot to the scaffold. In practice, and empty mortar pot can be replaced by a full one while the mason is laying a row of bricks so that there is no loss of operating time while the mortar pots are being exchanged. Also, since the overhead crane is universally movable over the work area in the plant, its movements are minimized so that the time required for servicing the various scaffolds and for transferring completed panels from the workbenches to the storage area 58 is minimized.

Figure 5:
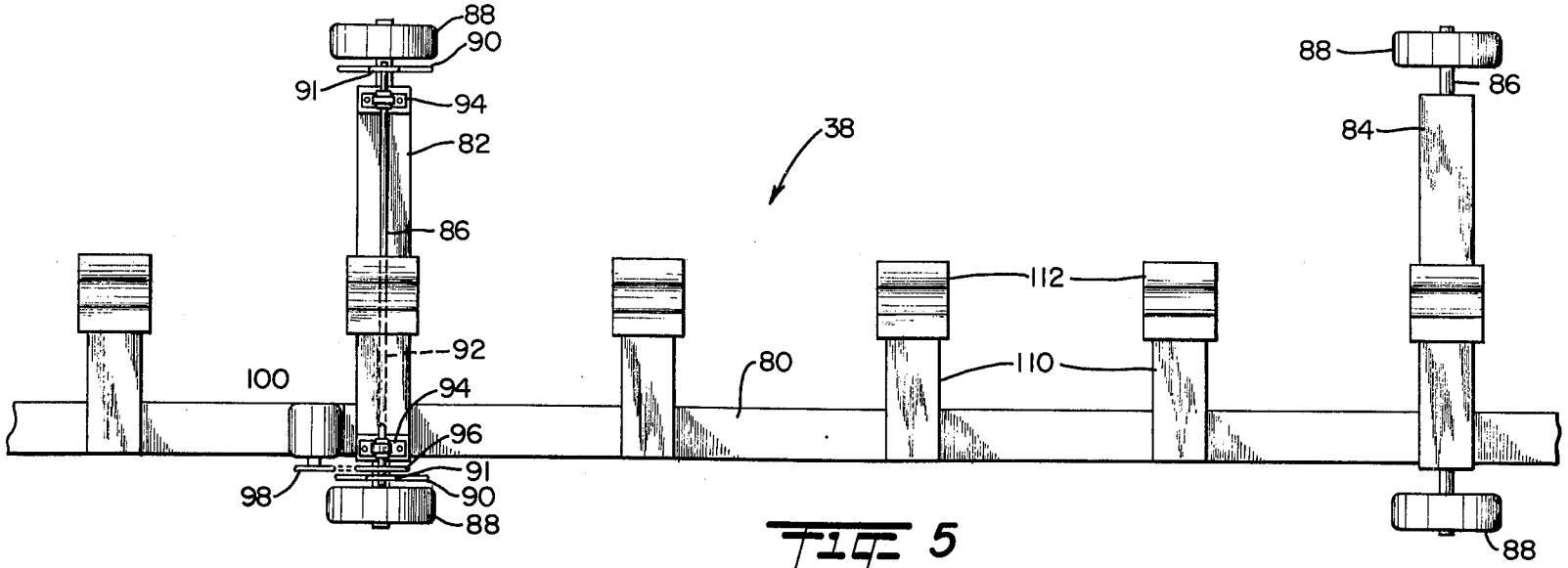
FIG. 5 is an enlarged plan view of the motorized mortar pot storage cart of the present invention.
Figure 6:
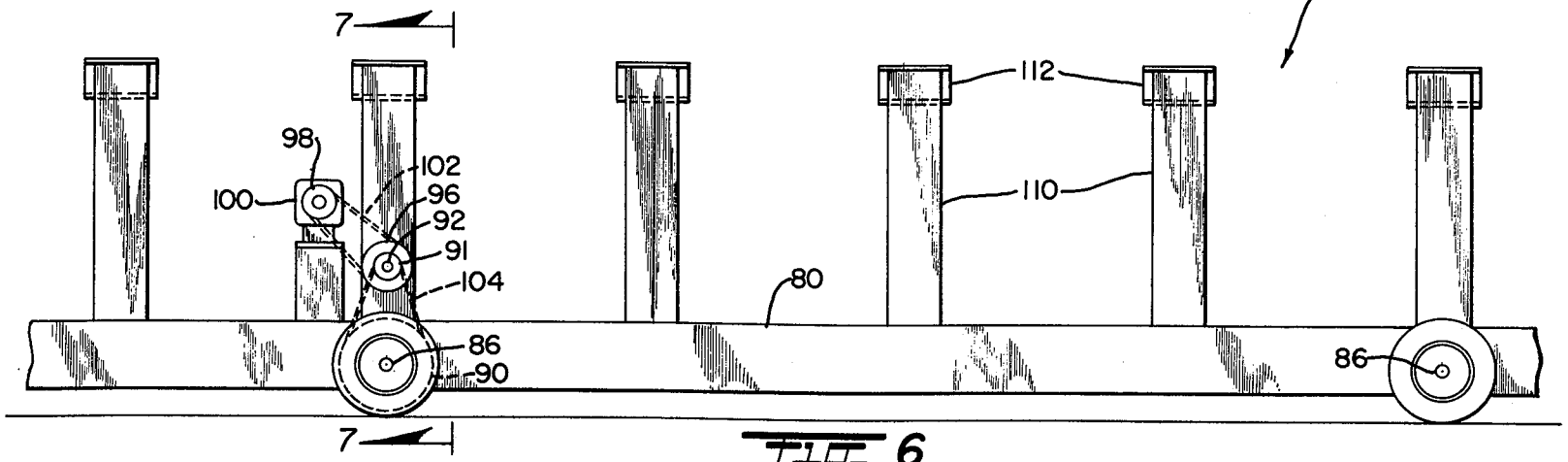
FIG. 6 is an enlarged side elevation of the cart of FIG. 5.
Figure 7:
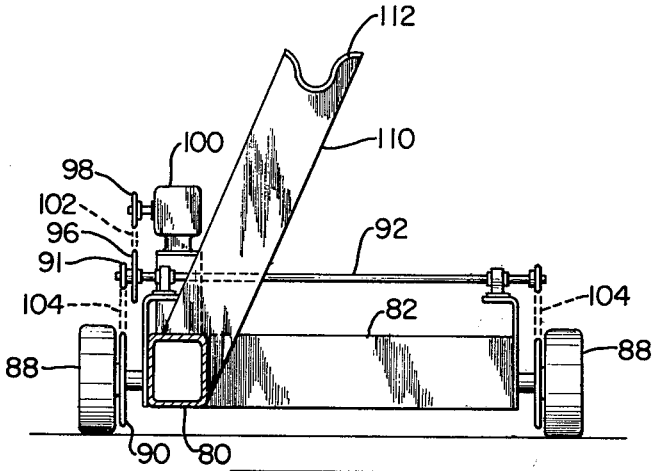
FIG. 7 is an enlarged section taken along line 7—7 of FIG. 6.

Referring now to FIGS. 5–7, the motorized mortar pot storage cart 38 is shown. The motorized cart 38 can be seen to have a longitudinally extending side frame member 80 and two transverse frame members 82 and 84 which are welded at one end to the side frame member 80 so that they extend normally away therefrom. The side frame member and the transverse frame members are tubular elements which have square cross-sections. Both of the transverse frame members 82 and 84 have an axle 86 journaled therein. Each of the axles carries on both of its ends a pneumatic wheel 88. The axle 86 in the transverse frame member 82 is provided near each end adjacent the pneumatic wheels 88 with a sprocket 90 rigidly fixed on the end thereof and in vertical alignment with smaller sprockets 91 on the ends of a transfer shaft 92 journaled in brackets 94 mounted on the top of the transverse frame member 82. The transfer shaft 92 also carries a drive sprocket 96 which is aligned with a drive sprocket 98 rigidly affixed to the output shaft of a reversible electric motor 100. The drive sprocket 96 is operably linked to the drive sprocket 98 on the motor by a chain 102 whereby rotary motion of the drive sprocket 98 is transferred to the transfer shaft 92. Rotary motion of the transfer shaft 92 is transferred to the pneumatic wheels 88 on the axle 86 by a pair of chains 104 which connect the sprockets 91 on the ends of the transfer shaft 92 to the sprockets 90 on the axle 86. It is thus apparent that by operating the motor 100, the carriage can be reciprocally driven in a straight line extending beneath the mortar mixer 26, so that any one of the mortar dispensing pots 36 supported by the storage cart 38 can be appropriately positioned beneath the mixer 26 for filling.

Welded to the longitudinal side frame member 80 of the storage cart at spaced intervals along its length are angularly disposed supporting arms 110 each of which has a saddle-shaped upper end 112 adapted to receive diametrically extending supporting shafts on the mortar dispensing pots. The supporting arms 110 are welded to the side frame member 80 so as to provide a sturdy support structure. It will be observed that seven supporting arms are provided on the cart shown in FIGS. 5–7, so that six mortar dispensing pots can be supported on the cart at any time. However, depending upon the size of the plant and the need for dispensing pots, a storage rack of any length with supports for any desired number of mortar dispensing pots could be provided.

Figure 8:
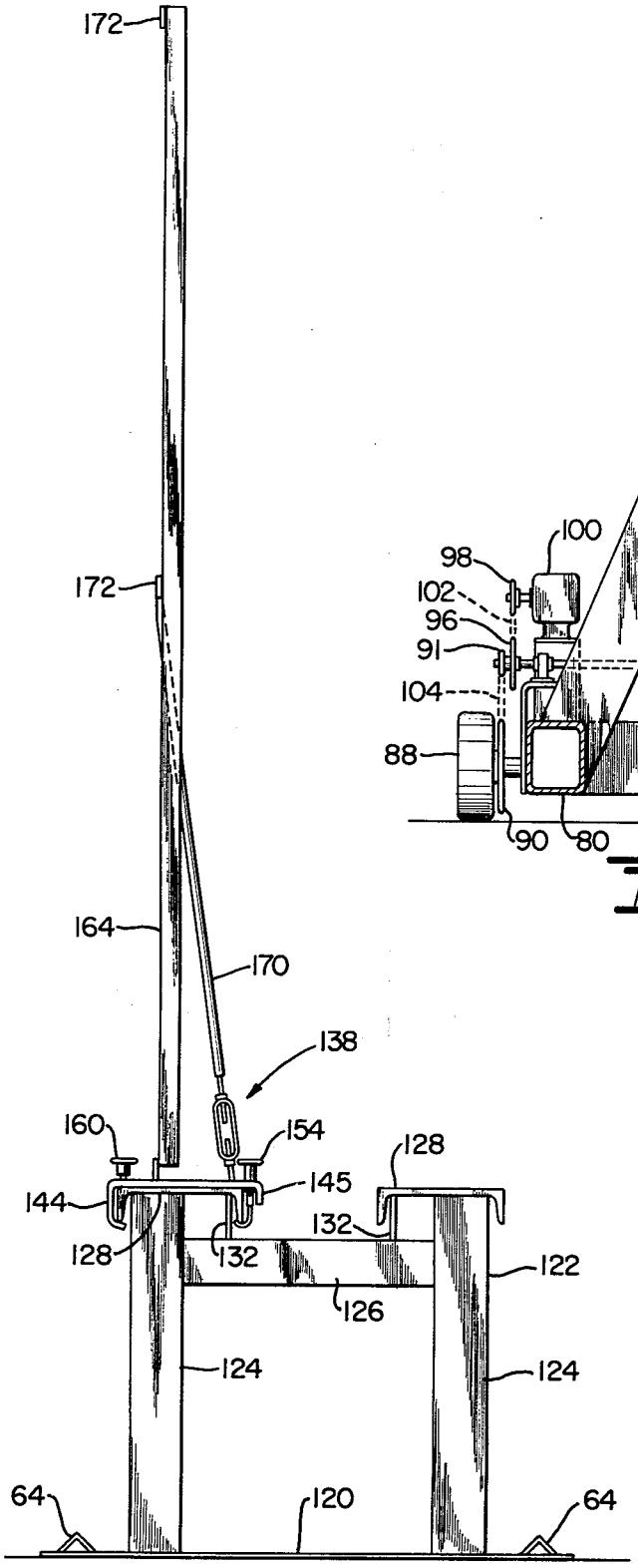
FIG. 8 is an end elevation of the workbench of the present invention.

The workbenches 62 are all identical and can be seen in FIG. 8 to be mounted on a base plate 120 which also has the tracks 64 for the motorized scaffold mounted thereon. The workbenches are provided with a plurality of vertical base frame member assemblies 122 which are comprised of two vertical side frame members 124 and a horizontal transverse frame member 126 welded to the side frame members 124 near the tops thereof. Two longitudinally extending work support platforms 128, which have inverted U-shaped cross-sections, are supported by the top ends of associated longitudinally aligned vertical side frame members 24 so that the work support platforms extend parallel to, slightly offset from, and above the tracks 64. To provide additional support for the work support platforms, separate pairs of support plates 132 are welded to the upper surface of the horizontal frame members 126 and extend upwardly against the underside of the associated work support platform. It is thus seen that each workbench has two work support platforms so that back-to-back brick panels can be constructed on each workbench. It should also be understood that the work support platforms are long enough so that a plurality of panels, depending on their length, can be constructed end-to-end on one work support platform.

Figure 10:
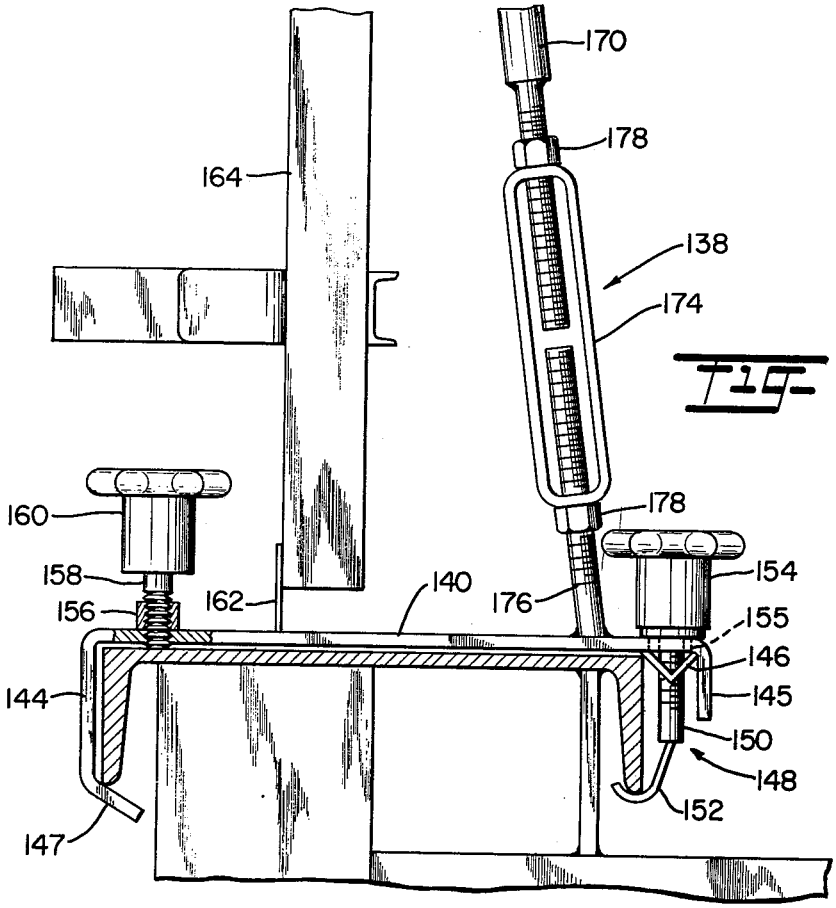
FIG. 10 is an enlarged fragmentary side elevation with parts in section of the panel guide assembly of FIG. 9.
Figure 9:
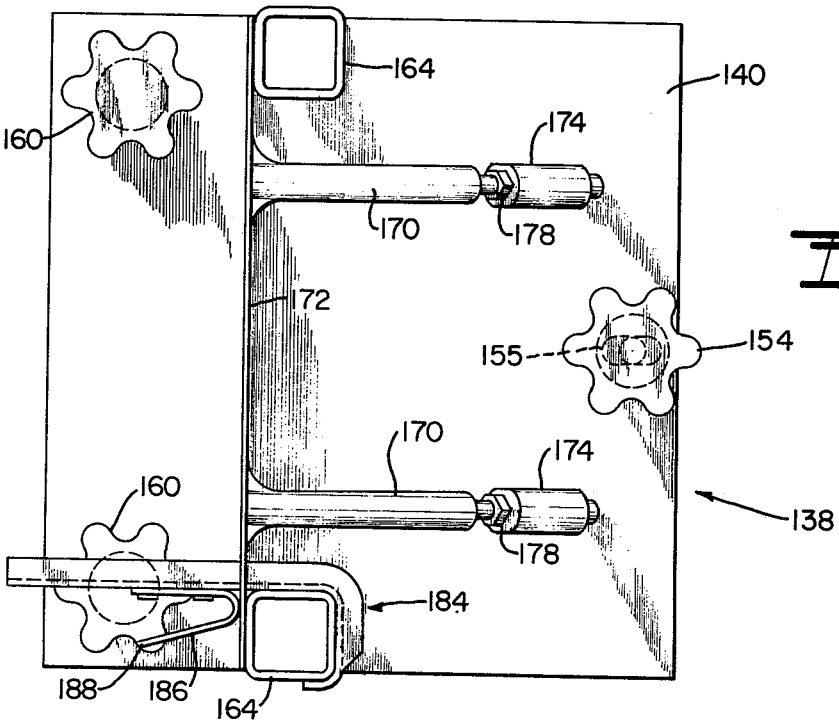
FIG. 9 is an enlarged plan view of the panel guide assembly shown as part of the workbench of FIG. 8.

Movable panel guide assemblies 138 (FIGS. 8–10) are provided with the work support platforms for the purpose of separating panels being fabricated thereon and for guiding and aligning the ends of the panels so that vertical side edges are attained. Each panel guide assembly is the same and can be seen in FIGS. 8–10 to have a substantially square-shaped base plate 140 which has two downturned edges 144 and 145 on opposite sides thereof. The downturned edges are seen to fit loosely down over the work support platform 128. An angle iron bar 146 is welded to the underside of the base plate adjacent to the edge 145 to positively position the base plate on the work support platform. The downturned edge 144 has an inwardly extending terminal end 147 which is adapted to extend underneath one of the downturned sides of the work support platform to hook the panel guide assembly to that side of the work support platform. The opposite side of the base plate 140 is anchored to the work support platform by a clamp assembly 148. The clamp assembly 148 is comprised of a stud bolt 150 which has a hook-shaped clamp 152 secured to its lower end adapted to hook under the opposite downturned side of the work support platform. The upper end of the stud bolt 150 has an adjustment knob 154 threaded thereon in a manner such that the clamp 152 can be drawn tightly against the downturned side of the work support platform by tightening the adjustment knob against the upper surface of the work support platform. The stud bolt 150 passes through a transversely extending elongated slot 155 in the work support platform so that the clamp assembly 148 can be released by loosening the adjustment knob 154 and pivoting the stud bolt 150 in the slot 155 so that the clamp 152 slides out from underneath the downturned side of the work support platform.

Welded to the upper surface of the base plate 140 adjacent the downturned side 144 are two longitudinally spaced internally threaded nuts 156. Each of the nuts 156 receives a threaded stub shaft 158 which has a lower end that extends through an aperture in the base plate 140 abutting against the upper surface of the work support platform, and an upper end that is rigidly secured to an adjustment knob 160. The function of the adjustment knobs 160 will be explained later.

An elongated support bar 162 welded to the upper surface of the base plate 140 extends parallel to the workbench and provides an attachment means for a pair of story poles or standards 164. The lower ends of the story poles are welded to one side of the support bar 162 in spaced relation from the base plate 140, with one story pole adjacent one end of the base plate and the other story pole adjacent the opposite end of the base plate. The story poles are thus suitably disposed for guiding and aligning the ends of brick panels fabricated adjacent to and on either side of the panel guide assembly. It is, therefore, very important that the story poles be perfectly vertical so that the adjacent ends of the brick panels will also be vertical. To align the story poles so that they are vertical, as viewed from the sides of the workbench, the adjustment knobs 160 are tightened or loosened, regulating the pressure of the associated stud bolt 150 against the top of the work support platform so that the base plate 140 is raised or lowered adjacent the respective adjustment knobs, causing the base plate and the story poles to be angularly adjusted in one direction or another. To vertically align the story pole when viewed from the ends of the workbench, the effective length of a pair of tie rods 170 is regulated. The tie rods 170 are connected at their upper ends to the lower one of two vertically spaced cross bars 172. The respective cross bars 172 are secured to the story poles adjacent the top and the middle thereof to maintain a constant spacing between the story poles and to provide an attachment means on the story poles whereby the tie rods can be secured to the story poles at a location substantially removed from the base plate. The tie rods are each associated with one of the story poles and have threaded lower ends which receive one end of a pair of turnbuckles 174. The other end of the turnbuckles are threadedly received on a pair of stud bolts 176 horizontally spaced in a lateral direction from the associated story pole and welded to the top of the base plate 140. By turning a turnbuckle it will be apparent that the effective length of associated tie rod will be changed thereby causing the associated story pole to be pulled or pushed in a lateral direction so as to affect the vertical disposition of the story pole as viewed from the end of the workbench. Each story pole can flex slightly at its welded connection to the elongated support bar 152 so that the pole can be pivoted small amounts about that connection. Lock nuts 178 are threaded onto the lower end of the tie rods 170 and to the stud bolts 176 to lock the turnbuckle in position when the story poles have been properly aligned.

It will be apparent that in actual practice a panel guide assembly would be anchored to the workbench at either end of a wall to be fabricated on the workbench. With this arrangement, there would be a story pole 164 at either end of the panel or panels fabricated on one work support platform to vertically guide and align the ends of the brick panel as it is fabricated.

It is helpful when laying a row of bricks to have a horizontal string guide to maintain each row of bricks in a perfectly horizontal orientation. The panel guide assemblies of the present invention are perfectly suited for anchoring the ends of the horizontal string guide through the use of clamp assemblies 184 which are adapted to be attached to the story poles at any desired elevation. A clamp assembly 184, best seen in FIGS. 8 and 10, can be seen to have a substantially U-shaped configuration with the hooked end of the assembly adapted to be tightly received on a story pole with the remainder of the assembly extending horizontally away therefrom. A leaf spring 186 is riveted to the clamp assembly in a position to tighten the hooked end of the clamp onto the story pole. The leaf spring is designed so that pressure on its outwardly extending end 188 loosens the clamp from the story pole so that it can be easily removed or slid along the length of the story pole to a new desired position. A string tied to clamp assemblies at both ends of a panel could be tautly maintained so that a perfectly horizontal guide line would be provided for the mason.

When fabricating brick panels according to the method of the present invention, a workman in the mixing room 22 would operate the auger conveyor 30 to transport a desired quantity of sand from the sand pit 28 to the scale 31. The quantity of sand, of course, is dependent on the quantity of mortar to be mxied and upon the specific proportions of sand, bonding material, and water. When the desired quantity of sand has been conveyed to the scale 31, the auger conveyor is turned off and the sand on the scale dumped into the mixer 26 along with the desired proportions of water and the bonding material.

When the ingredients have been properly blended, the motorized mortar pot storage cart 38 is driven forward or back by the workman in the mixing room to position an empty mortar pot 36 beneath the mixer 26. The cap of the selected mortar pot is then lifted by the crane 42 and the mixer is pivoted to allow the mixed mortar to pass through the discharge chute and be poured into the mortar pot. The cap is then lowered back onto the mortar pot and sealed in position.

The mortar pot is transferred by the crane from the storage cart 38 to a motorized scaffold 40. After lowering the mortar pot onto the motorized scaffold 40, the crane moves into a position overlying the brick storage section 58 of the plant 20, picks up a bundle of bricks and transports them to the same scaffold 40. As mentioned before, the crane is also utilized to keep the scaffold supplied with the mortar and bricks as the mason depletes his supplies.

The mason who operates the scaffold, before beginning to fabricate a brick panel, locks a pair of panel guide assemblies 138 to the adjacent work support platform 128 at each location where a panel is to be fabricated and at a spacing equivalent to the length of the brick panel to be fabricated. He then aligns the story poles 164 using a workman's level and the adjustments provided on the panel guide assemblies for aligning the story poles.

The mason, then having completed his preparations, positions the scaffold at one end of the work area adjacent one of the story poles and starts the scaffold moving along the track 64 adjacent the work support platfom toward the other story pole. As the scaffold moves along the side of the work support platform, the mason places a first row of brick in end-to-end relation, filling the vertical joints between the bricks with mortar from the mortar pot on the scaffold. A conventional hand trowel is used to facilitate filling of the vertical joints. It may be desirable when laying a row of bricks to intermittently drive the scaffold along the track 64 so that adequate time is allowed for placing the bricks and filling the vertical joints. For this reason it is desirable that the scaffold be provided with foot-operated controls so that the mason's hands are free to perform the conventional bricklaying functions.

When the first row of bricks has been laid, the mason positions the horizontal string guide clamp 184 on the adjacent story pole so that it is elevated from the top of the first row of bricks a distance equivalent to the height of a brick and a horizontal mortar joint. He then reverses the direction of movement of the scaffold so that it is moving back toward his starting position. As the scaffold moves along the work support platform, the mason spreads an even layer of mortar on top of the previously laid bricks to form the horizontal mortar joints. The horizontal mortar joints are spread with mortar dispensed under pressure from the mortar pot and the scaffold is continuously driven so that a smooth layer of mortar is spread.

Upon reaching his starting position, he raises the horizontal string guide clamp 184 on the then adjacent story pole so that the guide string is perfectly horizontal and at a level which is elevated a brick height from the horizontal mortar joint. The positioning of the horizontal string guide clamps 184 can be done by sight with but a little experience in laying brick so that no positioning notches are necessary on the story poles to position the clamps 184. Notches could be provided however at predetermined locations along the story poles if desired.

After the horizontal string guide clamp 184 has been positioned, the mason again reverses the direction of movement of the scaffold and places a second row of bricks on top of the horizontal mortar joint, again filling the vertical mortar joints between the bricks with a hand trowel. The horizontal string guide assures the mason that each row of bricks is substantially horizontal.

As the panel height increases, the mason elevates the scaffold so that the top row of bricks is conveniently disposed, i.e., at waist level. It is therefore desirable that a scaffold be used which is capable of moving vertically as well as horizontally so that the mason can position himself anywhere within vertical plane adjacent to or alongside the work support platform.

When the desired height panel has been laid, the mason drives the scaffold back and forth in front of the panel, stripping excess mortar from the mortar joints, thereby finally preparing the panel. The panel, after the mortar has dried, is lifted from the workbench and transported to the storage area 58 or onto the loading docks for storage until ready for shipment to a construction site.

It will be evident that, depending on the length of panel being fabricated, more than one panel can be fabricated simultaneously on a single work support platform by setting up a plurality of panel guide assemblies and fabricating end-to-end panels on the same work support platform. When fabricating a plurality of panels on a single work support platform, the scaffold is driven along the work support platform so that each panel is worked on with each pass of the scaffold whereby the panel heights of the separate brick panels rise together.

It is to be understood from the foregoing that various changes and modifications may be made therein without departing from the spirit and scope of the invention as defined by the appended claims.

What is claimed is:

1. A method of fabricating a panel of brick on a workbench comprising the steps of placing a supply of bricks and a supply of mortar on a horizontally movable platform, moving the platform in a first horizontal direction adjacent the workbench, placing bricks from the platform in a first row on the workbench as the platform moves along the side thereof, reversing the direction of movement of the platform so that it moves in a second horizontal direction opposite to the first direction while spreading a layer of mortar from the mortar supply onto the top of the bricks in the first row as the platform moves in the second direction, reversing the direction of the platform again so that it is again moving in the first direction while placing a second row of bricks on the spread layer of mortar, and repeating the steps of successively spreading mortar on a completed row and placing a row of bricks thereon in each successive traversal of a row until a completed panel of the selected length and height is formed.

2. The method of claim 1 further including the steps of filling mortar in the vertical joints between bricks in said first row and filling mortar in the vertical joints between bricks in said second row.

3. The method of claim 1 wherein said platform is also vertically movable and further including the step of elevating said platform relative to said work-bench prior to placing said second row of bricks on said workbench.

4. The method of claim 1 wherein the movement of the platform in the first direction is intermittent and the movement in the second direction is continuous.

5. The method of claim 1 wherein each successive row of bricks is laid in a plurality of horizontally spaced side-by-side sections whereby more than one panel is fabricated on the same workbench.

6. A method of prefabricating brick panels in a plant having a storage area for a supply of bricks, a plurality of workbenches, and motorized scaffolds disposed for reciprocal movement along both sides of the workbenches comprising the steps of mixing a supply of mortar, pouring the mortar into a plurality of mortar pots stored on a storage cart, transferring the mortar pots by overhead crane means from the storage cart to the motorized scaffolds, transferring bricks from the storage area to the motorized scaffolds, moving the scaffolds in a first horizontal direction adjacent the side of the associated workbenches, placing bricks from the scaffolds in a first row on the associated workbenches as the scaffolds move along the sides thereof, reversing the direction of movement of the scaffolds in a second horizontal direction opposite to said first direction and spreading a layer of mortar onto the top of the bricks in said first row as the scaffolds move in said second direction, again reversing the direction of movement of the scaffolds in said first direction and placing a second row of bricks on the spread layer of mortar.

* * * * *